US006393237B1

(12) United States Patent
Shindo

(10) Patent No.: US 6,393,237 B1
(45) Date of Patent: May 21, 2002

(54) SCOROTRON CHARGING APPARATUS

(75) Inventor: Kazunori Shindo, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/716,377

(22) Filed: Nov. 21, 2000

(30) Foreign Application Priority Data

Nov. 26, 1999 (JP) ..... 11-336632

(51) Int. Cl.[7] ..... G03G 15/02
(52) U.S. Cl. ..... 399/171; 399/172
(58) Field of Search ..... 399/168, 170, 399/171, 172, 311; 250/324; 361/225

(56) References Cited

U.S. PATENT DOCUMENTS 3,578,970 A * 5/1971 Michaud et al. ..... 361/225 X
4,745,282 A * 5/1988 Tagawa et al. ..... 399/171 X
5,526,222 A * 6/1996 Fender ..... 361/225 X
5,655,186 A * 8/1997 Godlove et al. ..... 399/171

* cited by examiner

*Primary Examiner*—Sandra Brase
(74) *Attorney, Agent, or Firm*—McGinn & Gibb, PLLC

(57) ABSTRACT

A scorotron charging apparatus includes a wire, a shield, a grid, and a side seal arranged between the grid and the shield. The side seal includes a conductive material.

11 Claims, 6 Drawing Sheets

SCOROTRON CHARGING APPARATUS

BACKGROUND OF THE INVENTION

1. Field of the Invention

The present invention relates to a scorotron charging apparatus consisting of a wire, shield, and a grid used in an electrophotographic apparatus including a printer and a copying apparatus and in particular, to a scorotron charging apparatus including a side seal arranged between the grid and the shield.

2. Description of the Related Art

It is known that in a conventional scorotron charging apparatus in an electrophotographic apparatus, charging can be performed with less wire current by increasing the shield voltage.

As shown in FIG. 7, the conventional scorotron charging apparatus is an electric charger including a shield 31, a grid 33, and a wire 34. In this electric charger, the voltage of the shield 31 is increased to obtain a potential between the grid 33 and the wire 34 while a sufficient interval "a" is required between the shield 31 and the grid 33 so that no arc discharge is caused. For this, ozone leaks through the interval "a" in this electric charger.

Moreover, as shown in FIG. 8, another type of conventional scorotron apparatus includes a shield 41, a grid 43, a wire 44, and an insulation material 42 covering the space between the shield 41 and the grid 43, so that no ark discharge is caused between the shield 41 and the grid 43 and leakage of ozone can be prevented. In the space inside this electric charger, a great amount of ion in generated. In this structure, the ion adheres to the insulation material 42 to cause charging. Moreover, when the charging potential of the insulation material 42 exceeds a predetermined value, arc discharge is caused with respect to the shield 41 and the grid 43, causing an incorrect operation of a control circuit in the vicinity due to noise.

SUMMARY OF THE INVENTION

It is therefore an object of the present invention to provide scorotron charging apparatus including a side seal made from a semiconductor material arranged between the grid and shield so as to increase the charging efficiency and assure a uniform and stable charging.

The scorotron charging apparatus according to the present invention comprises: a wire; a shield; a grid; and a side seal arranged between the grid and the shield.

According to another aspect of the present invention, the side seal may be made from a semiconductor material.

According to still another aspect of the present invention, the side seal may have a resistance value in a range from 1 to 100 MΩ.

According to yet another aspect of the present invention, the side seal may be made from a conductive plastic containing a conductive agent such as carbon.

According to still further aspect of the present invention, the conductive plastic may be polycarbonate or polyacetal containing a conductive agent such as carbon.

According to yet still another aspect of the present invention, the side seal may be made from a material having a resistance value in a range from 1M to 1000 MΩ cm.

According to still yet another aspect of the present invention, the current flowing into the side seal may create a voltage inclination.

According to yet another aspect of the present invention, the side seal may be made from a flat plate.

According to still another aspect of the present invention, a plurality of holes may be opened in the back surface of the shield for exhausting air.

According to still yet another aspect of the present invention, the apparatus may further comprise a fan arranged for generating an air flow through the plurality of holes for exhausting air.

DESCRIPTION OF THE PREFERRED EMBODIMENTS

Description will now be directed to an embodiment of the present invention with reference to the attached drawings.

Figure 1:
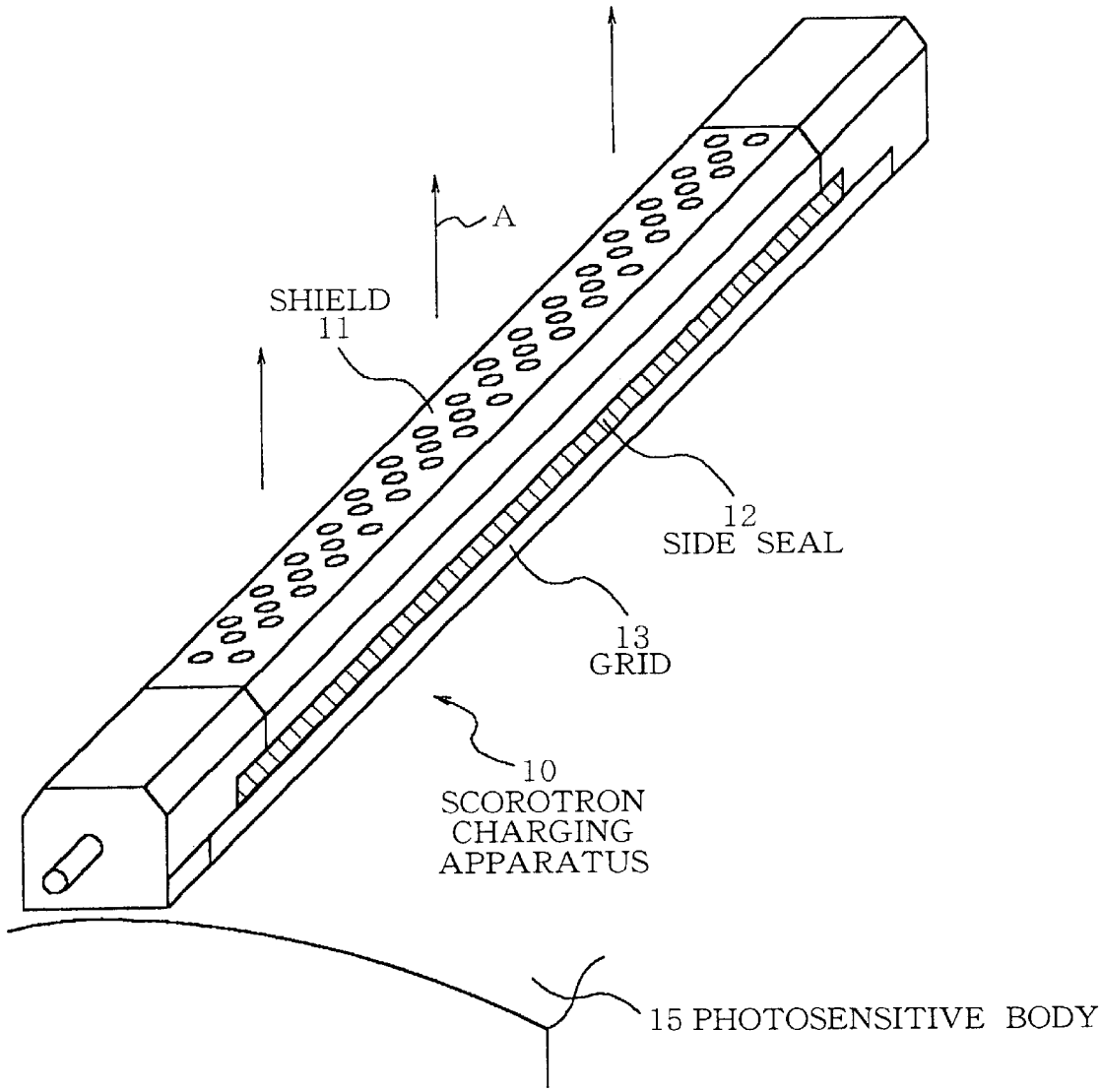
FIG. 1 is a perspective view showing a scorotron charging apparatus according to an embodiment of the present invention.
Figure 2:
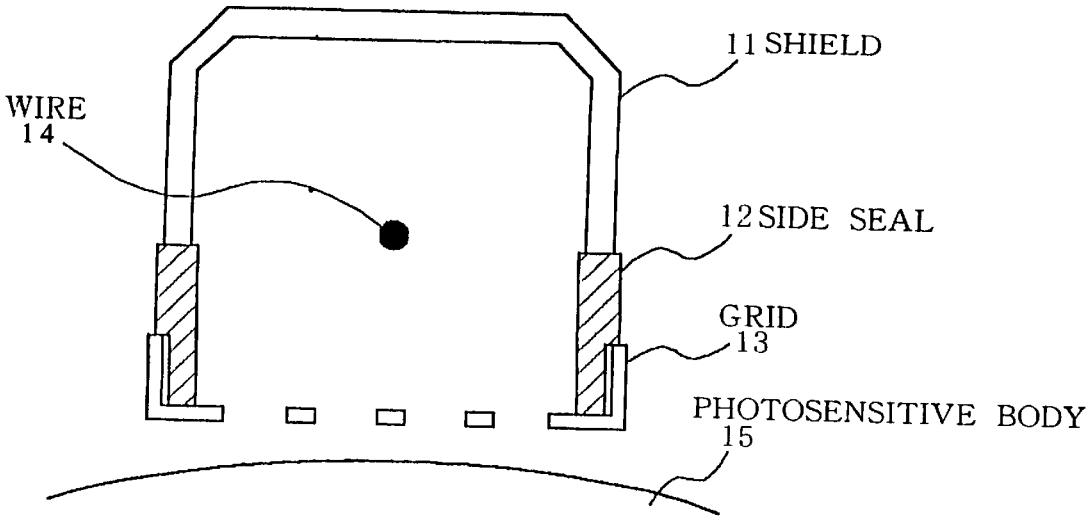
FIG. 2 is a cross sectional view showing the scorotron charging apparatus according to the embodiment of the present invention.

FIG. 1 is a perspective view and FIG. 2 is a cross sectional view of the scorotron charging apparatus according to the embodiment of the present invention. In FIG. 1 and FIG. 2, the embodiment of the present invention includes a scorotron charging apparatus used in electcro-photographic apparatuses such as a printer and a copying apparatus. The scorotron charging apparatus includes a shield 11, a side seal 12, a grid 13, and a wire 14, against which a photosensitive body 15 is arranged.

The shield 11 is a metal plate made from stainless steel or the like and is arranged so as to surround the wire 14. The grid 13 is made from a plurality of wires or a thin metal plate having a thickness of 0.1 to 0.5 mm and is arranged so as to face to the photosensitive body 15 at a distance of 1.5 to 3 mm. The side seal 12 is a flat plate made from a conductive plastic such as polycarbonate and polyacetal containing a conductive agent such as carbon and is electrically connected to the shield 11 and to the grid 13.

Figure 3:
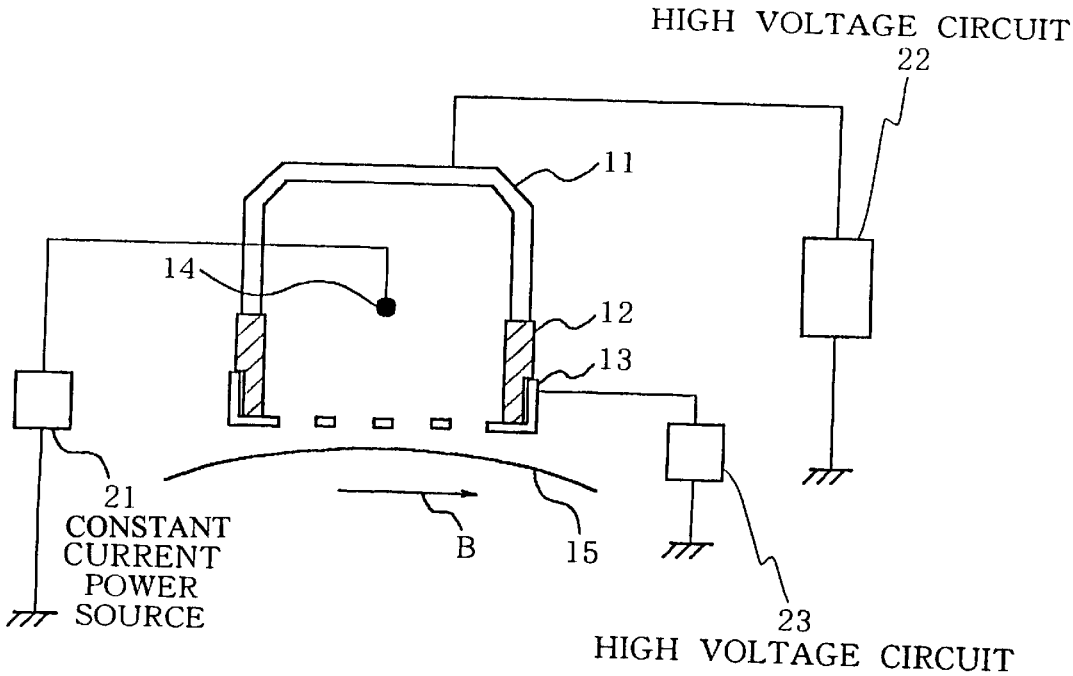
FIG. 3 explains operation in the scorotron charging apparatus according to the embodiment of the present invention.

FIG. 3 shows a configuration explaining operation of the scorotron charging apparatus according to the embodiment of the present invention. In FIG. 3, the shield 11 is maintained at a constant voltage of 1 to 4 kV by a high voltage circuit 22. The high voltage circuit 22 is a circuit utilizing a voltage generating circuit or a constant voltage element such as Zener diode and varistor.

The grid 13 is maintained at a constant voltage of 600 to 900 V by the high voltage circuit 23. The high voltage circuit 23 is a circuit utilizing a voltage generating circuit or a constant voltage element such as Zener diode and varistor.

Figure 4:
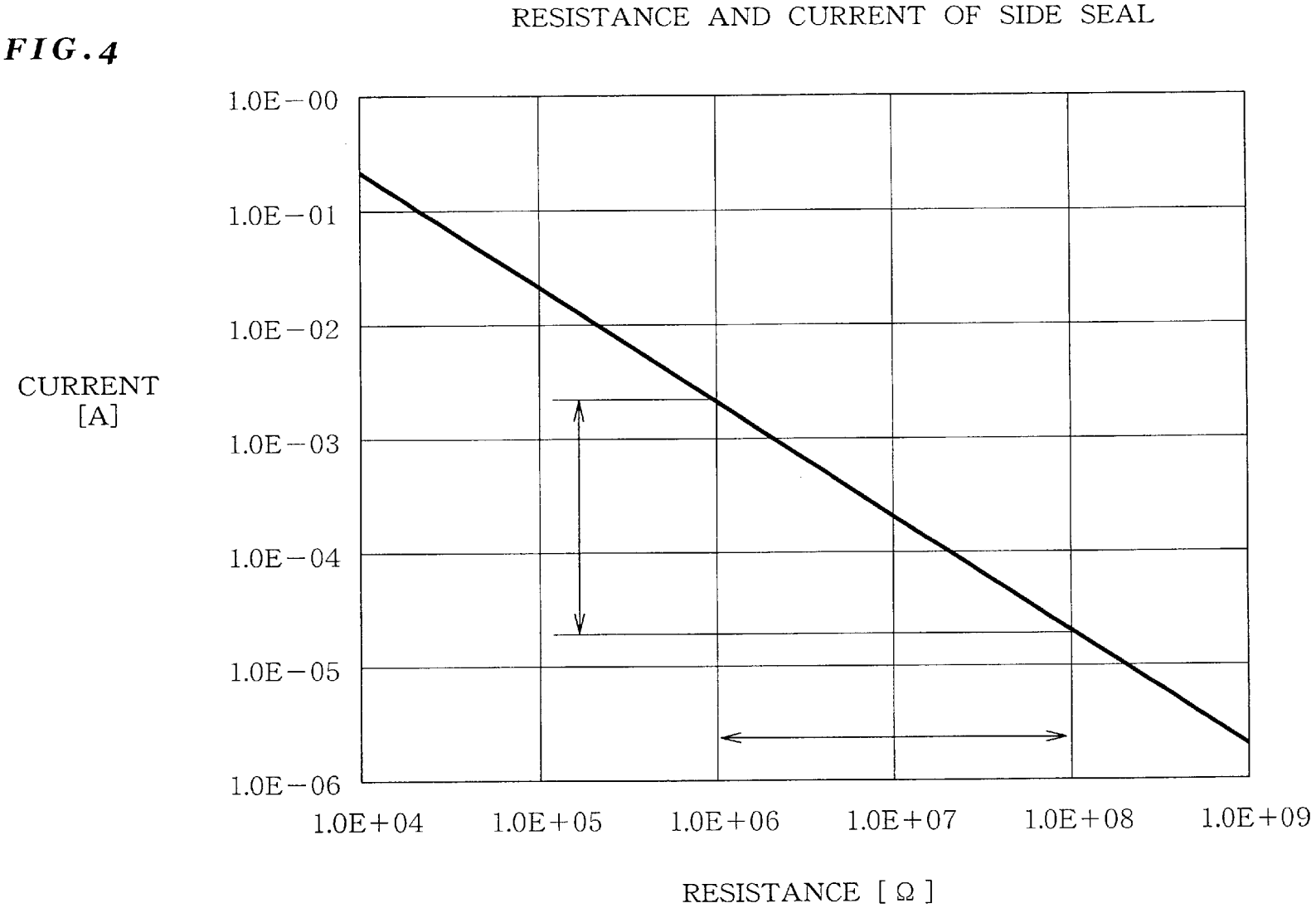
FIG. 4 graphically shows the relationship between the resistance of the side seal and current in the embodiment of the present invention.

The current flowing through the side seal 12 is determined by a potential difference between the grid 13 and the shield 11, and the internal resistance of the side seal 12. The resistance value is determined in such a way, as shown in FIG. 4 (relationship between the resistance and current of the side seal), that a stable current not less than 10 $\mu$A flows and that no excessive heat is caused under 10 mA. This is because if the current is too great, a heat is generated to increase the temperature of the side seal 12 itself and the side seal 12 may be deformed. Accordingly, the resistance of the side seal 12 should be set in a range from 1 to 100 MΩ which is adjusted by the amount of carbon contained in the material.

Figure 5:
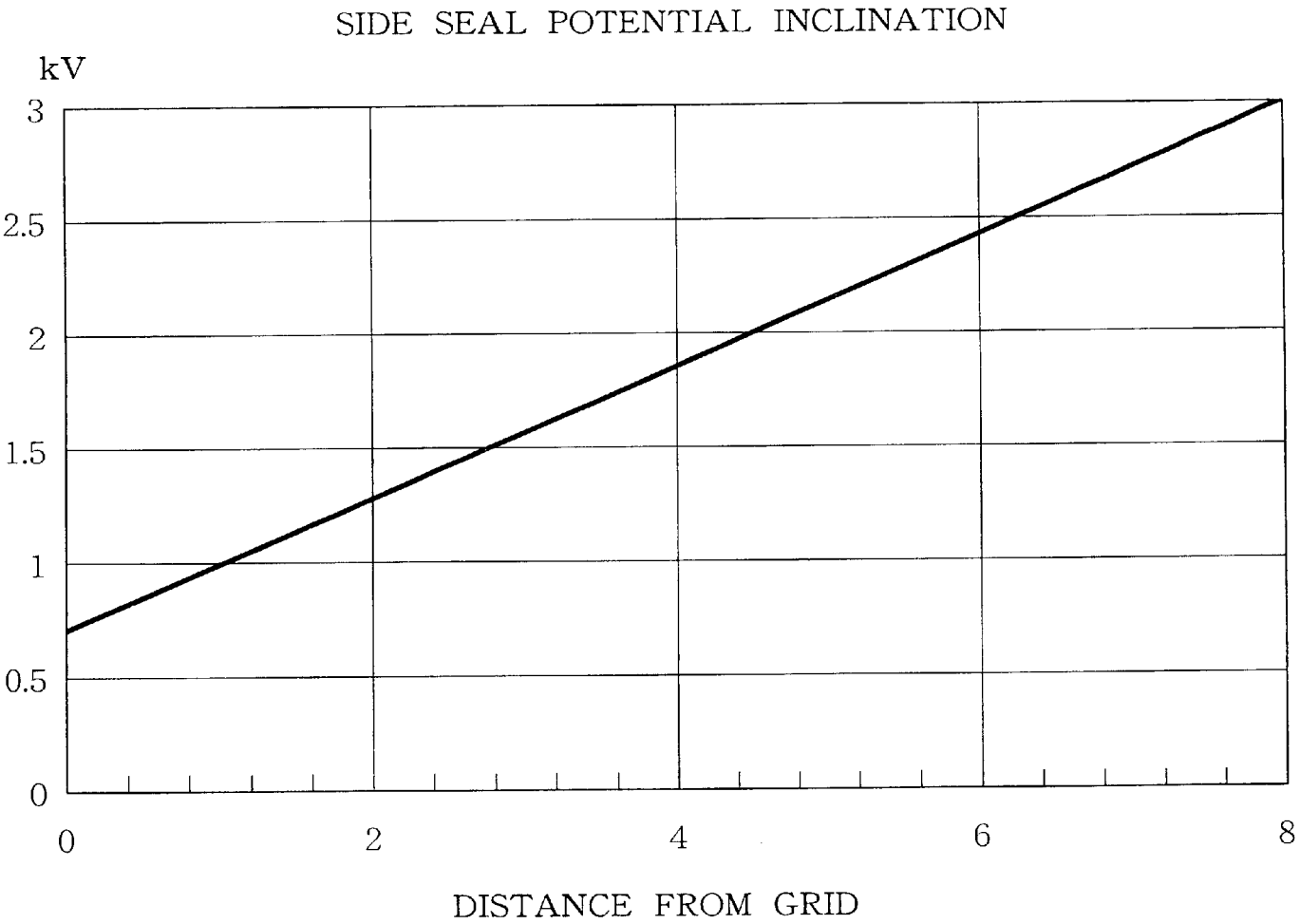
FIG. 5 graphically shows a potential inclination of the side seal in the embodiment of the present invention.

It should be noted that FIG. 5 shows a potential inclination of the side seal 12. As shown in FIG. 5, the contact point between the side seal 12 and the grid 13 has a potential of 700 V which is identical to that of the grid and the potential at the contact surface between the side seal 12 and the shield 11 is identical to the shield potential of 3 kV. Between them, voltage is distributed according to the resistance value of the side seal and this inclination is called voltage inclination.

The wire 14 is subjected to a constant current drive of 100 to 600 $\mu$A by a constant current power source 21. Here, the potential of the wire 14 becomes 4 to 8 kV, generating corona discharge between the wire 14 and the shield 11.

The photosensitive body 15 moves in the direction indicated by arrow B in FIG. 3 and is charged by ions which have passed through grid 13. As the photosensitive body 15 moves downstream, the surface potential is increased and when the electric field strength between the photosensitive body 15 and the grid 13 is reduced, ion movement is reduced and the surface potential becomes stable at a constant value.

Figure 6:
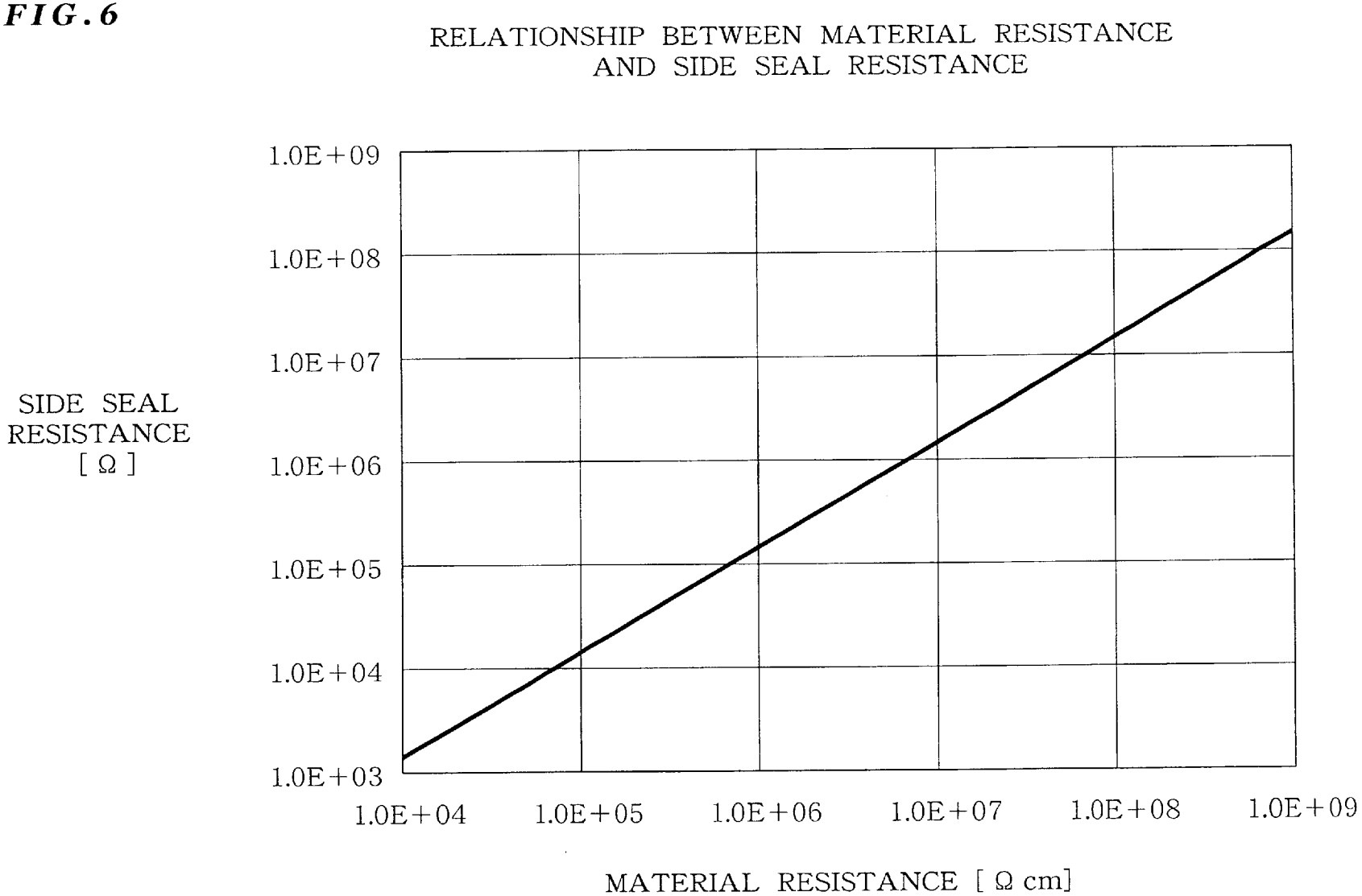
FIG. 6 graphically shows the relationship between a material resistance and the side seal resistance in the embodiment of the present invention.
Figure 7:
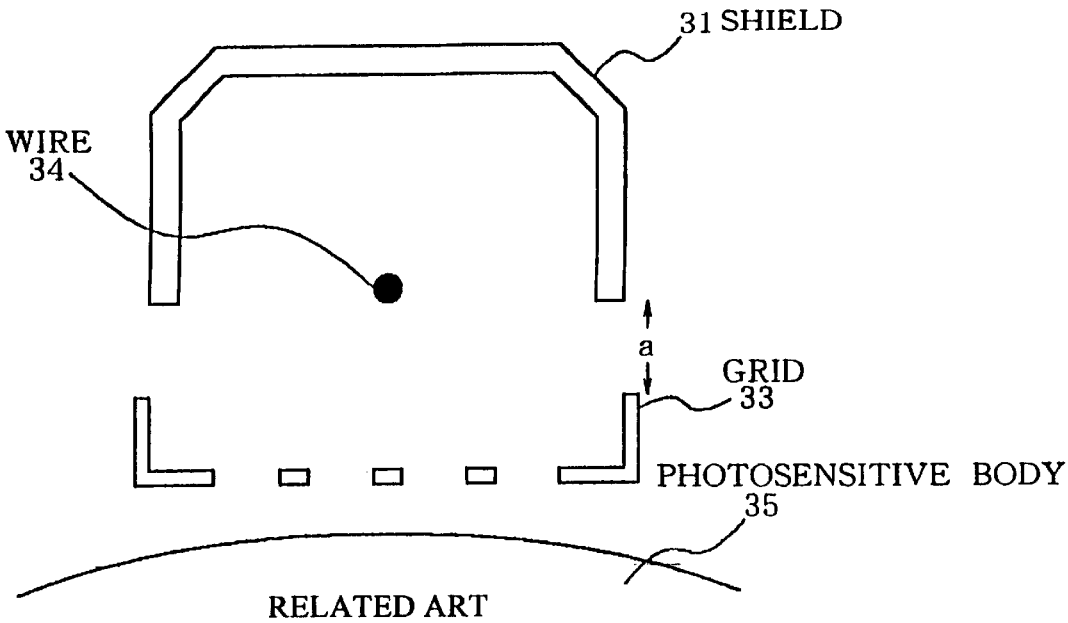
FIG. 7 is a cross sectional view of a conventional scorotron charging apparatus.
Figure 8:
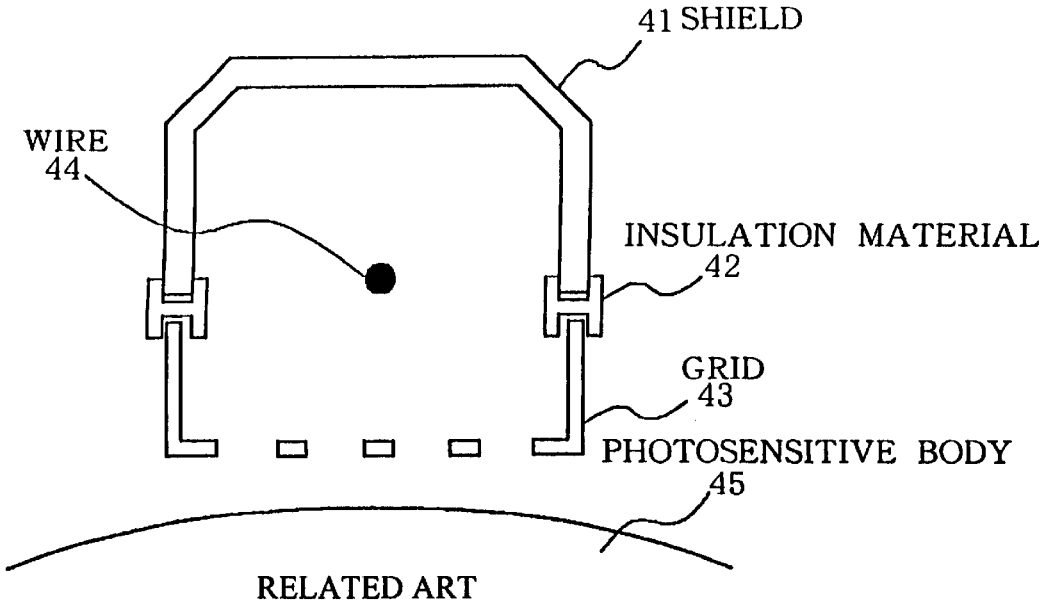
FIG. 8 is a cross sectional view of another conventional scorotron charging apparatus.

Next, explanation will be given on another embodiment of the present invention. In this second embodiment, as shown in FIG. 6 (relationship between the material resistance value and the side seal resistance value), when considering the side seal configuration and size, the appropriate material resistance value is 1 to 1000 MΩ cm. The material may be other metal, non-metal, or organic material if it has the resistance value in the range from 1 to 1000 MΩ cm.

Furthermore, in the second embodiment of the present invention, in order to prevent deterioration of the photosensitive body by ozone, a plurality of holes are opened in the back surface of the shield for exhausting air and a fan is arranged to cause an air flow in the direction indicated by arrow A in FIG. 1, so that the ozone in the shield is pulled in the opposite direction with respect to the photosensitive body. Accordingly, ozone in the shield can be effectively exhausted, reducing the contact of the ozone with the photosensitive body, thereby preventing deterioration of the photosensitive body characteristic due to oxidation of the surface.

As has been described above, in the scorotron charging apparatus according to the present invention, the ion generated by the wire is effectively moved toward the photosensitive body because the grid and the photosensitive body have a lower voltage than the shield, and by setting the shield voltage to a high voltage having an identical polarity as the wire, it is possible to effectively charge the photosensitive body.

Furthermore, since in the scorotron charging apparatus, the amount of ozone generated is almost proportional to the wire current, in the present invention, for the high charging efficiency, the wire current can be reduced so as to reduce the ozone generation amount. Moreover, with the grid electric field effect, it is possible to assure a uniform charging.

Furthermore, in the scorotron charging apparatus according to the present invention, the side seal made from a semiconductor material is arranged between the grid and the shield, thereby creating a voltage inclination (inclined electric field) and enabling to obtain a stable discharge from the wire.

Moreover, in the scorotron charging apparatus according to the present invention, the wire is effectively sealed and it is possible to effectively collect generated ozone without dispersing it in the apparatus.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 11-336632 (Filed on Nov. 26$^{th}$, 1999) including specification, claims, drawings and summary are incorporated herein by reference in its entirety.

What is claimed is:

1. A scorotron charging apparatus comprising:

a wire;

a shield;

a grid; and a side seal arranged between the grid and the shield, wherein the side seal comprises a semiconductor material.

2. The scorotron charging apparatus as claimed in claim 1, wherein the side seal has a resistance value in a range from 1to 100 MΩ.

3. The scorotron charging apparatus as claimed in claim 2, wherein the current flowing into the side seal creates a voltage inclination.

4. The scorotron charging apparatus as claimed in claim 2, wherein the side seal comprises a flat plate.

5. The scorotron charging apparatus as claimed in claim 1, wherein the current flowing into the side seal creates a voltage inclination.

6. The scorotron charging apparatus as claimed in claim 1, wherein the side seal comprises a flat plate.

7. A scorotron charging apparatus comprising:

a wire;

a shield;

a grid; and a side seal arranged between the grid and the shield, wherein the side seal comprises a conductive material including carbon as a conductive agent.

8. The scorotron charging apparatus as claimed in claim 7, wherein the conductive material comprises one of polycarbonate and polyacetal including carbon as a conductive agent.

9. The scorotron charging apparatus as claimed in claim 7, wherein the side seal comprises a material having a resistance value in a range from 1 M to 1000 MΩ cm.

10. The scorotron charging apparatus as claimed in claim 7, wherein the current flowing into the side seal creates a voltage inclination.

11. The scorotron charging apparatus as claimed in claim 7, wherein the side seal comprises a flat plate.

* * * * *